United States Patent [19]

Brownlee

[11] 4,060,948

[45] Dec. 6, 1977

[54] STRUCTURAL FRAME FOR A BUILDING

[76] Inventor: Robert O. Brownlee, 353 McDonald Ave., Mobile, Ala. 36604

[21] Appl. No.: 716,817

[22] Filed: Aug. 23, 1976

Related U.S. Application Data

[63] Continuation-in-part of Ser. No. 394,771, Sept. 6, 1973.

[51] Int. Cl.[2] ..... E04B 1/18

[52] U.S. Cl. ..... 52/236.8; 52/259; 249/19; 52/587

[58] Field of Search ..... 52/585, 236.7, 236.8, 52/259, 251, 280, 726; 249/19–29

[56] References Cited

U.S. PATENT DOCUMENTS

| | | | |
|---|---|---|---|
| 865,336 | 9/1907 | Gardner | 52/236.8 |
| 980,480 | 1/1911 | Bishop | 52/725 |
| 1,060,853 | 5/1913 | Peirce | 52/723 |
| 1,214,964 | 2/1917 | Small | 52/587 |
| 1,514,245 | 11/1924 | Ambursen | 249/29 |
| 1,907,707 | 5/1933 | Baker | 249/29 |
| 3,495,371 | 2/1970 | Mitchell | 52/236.7 |
| 3,594,971 | 7/1971 | Hughes | 52/585 |
| 3,618,278 | 11/1971 | Mouton | 52/236.7 |
| 3,696,567 | 10/1972 | Villaneu | 52/127 |

FOREIGN PATENT DOCUMENTS

| | | | |
|---|---|---|---|
| 78,079 | 12/1949 | Czechoslovakia | 52/283 |
| 813,371 | 5/1959 | United Kingdom | 52/259 |
| 630,207 | 10/1949 | United Kingdom | 52/283 |

*Primary Examiner*—John E. Murtagh

*Attorney, Agent, or Firm*—Burns, Doane, Swecker & Mathis

[57] ABSTRACT

A structural frame for a building constructed of different sized precast reinforced or prestressed posts and beams permanently united at the job site by means of unitary poured concrete joint. Posts and beams are precast and will be used in the erection of the building when they have reached their maximum strength. Only sufficient concrete will be poured at the job site, as needed, to unite the posts and beams. Sleeves are molded in axial bores disposed in the ends of the posts. Metal rods disposed in the sleeves and bottomed in the bores are used to support an upper post a predetermined distance above the top surface of the adjacent lower post to provide a space in which the joint may be formed. Horizontal beams are externally supported with their ends adjacent and above the upper end of the lower post and flush with the vertical wall of the post. The horizontal beams do not rest upon the post. The cavity defined by the opposing ends of the posts and beams is enclosed with a form into which concrete is poured at the job site to form a unitary joint uniting the precast posts and beams.

6 Claims, 9 Drawing Figures

STRUCTURAL FRAME FOR A BUILDING

CROSS-REFERENCES TO RELATED APPLICATIONS

This application is a continuation-in-part of earlier filed pending application Ser. No. 394,771, filed Sept. 6, 1973, by Robert O. Brownlee for METHOD AND APPARATUS FOR ERECTING A BUILDING CONSTRUCTION.

FIELD OF THE INVENTION

This invention relates to a structural frame for a building constructed of different sized preformed posts and beams permanently united at the job site by means of a unitary concrete joint.

BACKGROUND OF THE INVENTION

Many buildings are formed of concrete poured at the job site to provide the needed posts and beams. This requires multiple forms at the job site and also a substantial delay in the erection of the building inasmuch as the large amount of concrete being poured must be allowed to set a predetermined extent before additional columns and beams can be supported thereon. No satisfactory method has been proposed heretofore utilizing preformed posts and beams.

A difficult problem arises when an architect wishes to join preformed posts and beams of different dimensions. The specific size of the beams is governed by the length of the span, the load to be carried per square foot and other similar factors peculiar to the particular building being designed. In a building poured at the job site, the concrete forms can be custom made to provide a variety of joints. However, this flexibility has not previously been available for buildings constructed of preformed posts and beams. The applicant's structural frame provides this flexibility to an architect.

Also in the past it has been necessary to place preformed beams in overlapping relationship to their respective supporting posts. When buildings are of low height but must carry a heavy load per square foot of floor space, then it would be advantageous to place the beams in such an overlapping relationship. However, when buildings are to be tall in height and perhaps narrow in width, then it is advantageous to place the beams in a position where the end of the beam is in line with the outside face of the post. This permits successive posts to be formed into a unitary full size column for its entire length thereby giving greater resistance to wind stresses and earth tremors. This invention provides a structure in which the posts are formed into a column having its full size throughout its entire length.

One object of the invention is to provide for the erection of concrete buildings with substnatially 95% of the concrete, other than the foundation piers, required for completing the framework to be poured off the job site in forms that can be reused and with only a minimum amount of concrete poured at the job site.

Another object of the invention is to provide for the convenient joining of various size beams over a common post to combine the economy of preformed construction with flexibility of design.

SUMMARY OF THE INVENTION

These and other objects may be accomplished by the structural frame of the applicant's invention constructed of different sized preformed concrete posts and beams permanently united at the job site by means of a unitary poured concrete joint. Sleeves are molded in axial bores disposed in the end of the posts. Metal rods disposed in the sleeves and bottomed in the bores are used to support an upper post a predetermined distance above the top surface of the lower adjoining post to provide space for the unitary joint at the job site. Horizontal beams which may be of different sizes are externally supported with their ends adjacent and above the upper ends of the lower post and flush with the vertical walls of the post. The horizontal beams do not rest upon the posts. The cavity defined by the opposing ends of the posts and beams is enclosed with a form of the kind disclosed in copending application Ser. No. 564,362 now U.S. Pat. No. 3,999,735. Concrete is poured at the job site into the form to provide a unitary joint uniting the posts and beams. Metal caps are molded in the posts at the ends of the bores to provide a bearing surface for the sleeves and rods.

When it is desired to use beams whose cross-sectional area is less than the surface area of the molding cavity adjacent the end of the beam, removeable filler blocks may be used between the opposing surfaces of the beam and the form in order to hold the beam in position and to fill the void left in the cavity enclosing form by the use of the smaller beam.

The use of filler blocks also provides flexibility in the appearance of the face of the structure. The exterior beams may be recessed or flush with the exterior vertical surfaces of the posts.

A principal advantage gained through the use of the support rod of the present invention is that the upper post may be placed in the desired suspended relation to the lower post before any of the beams that are to be united to the post are moved into place. This provides the architect or structural engineer with a choice as to both the size of the beams and the manner in which they are placed in relation to the columns to which they are being united. No previous structural frame for a building provides the architect or structural engineer with this design flexibility.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
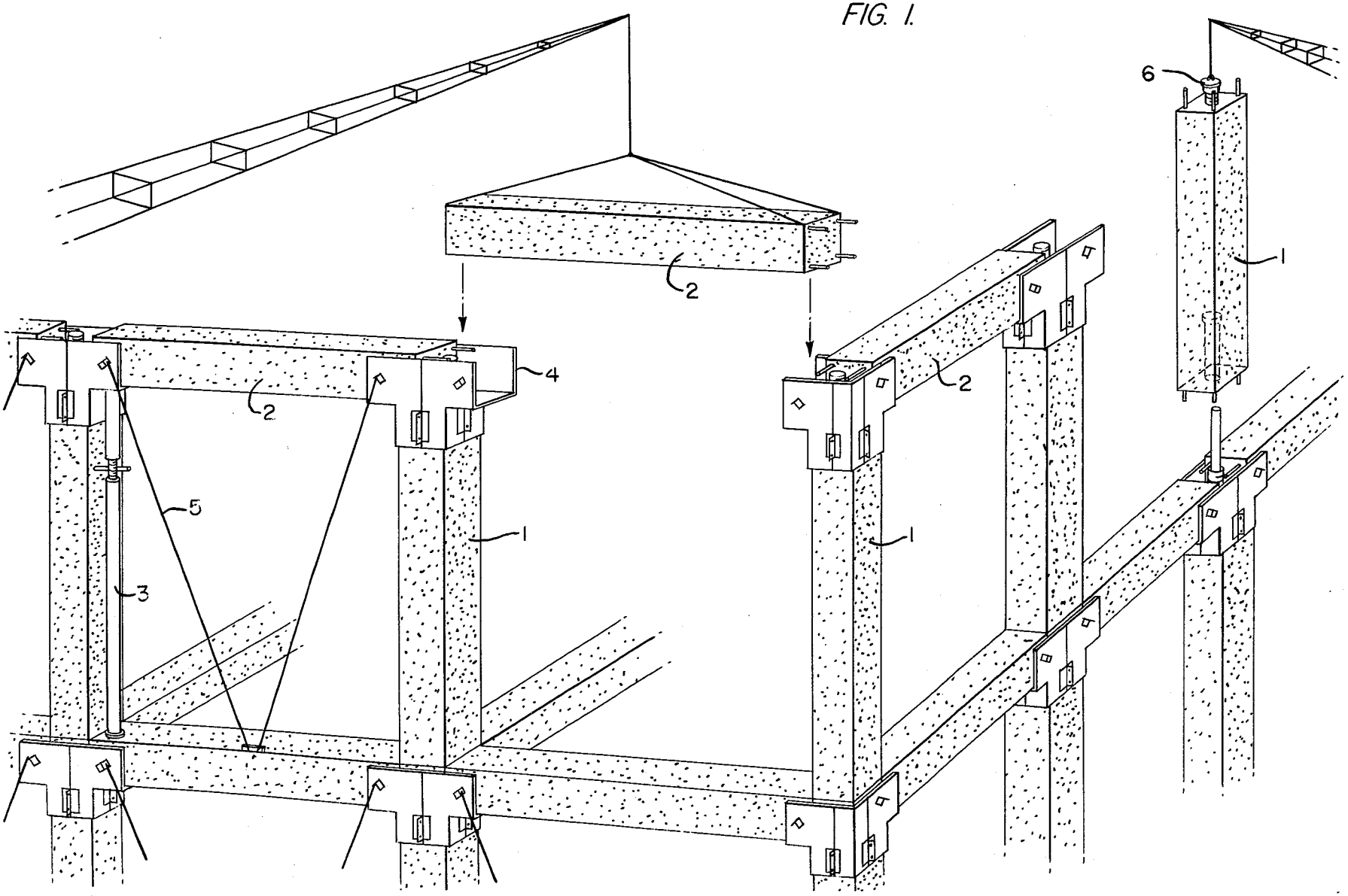
FIG. 1 is a perspective view of a partially completed structural frame for a building built in accordance with the invention.

Referring now to FIG. 1, there is shown a partially completed structural frame constructed in accordance with the invention using preformed posts 1 and preformed beams 2 being hoisted into position by a crane. The uppermost beams are supported by means of jacks 3 resting on previously erected lower beams. The ends of beam 2 are held in alignment with their corresponding posts by means of removable concrete forms 4 of the kind disclosed in the copending application, Ser. No. 564,362. Forms 4 are removably affixed around the top of post 1 in the manner disclosed in the said copending application. The bottommost post (not shown) may be assembled on a suitable foundation which will be of whatever character may be found desirable by the architect.

Transverse support to the structure during construction is provided by adjustable guy connections 5 suitably joined between the forms and adjacent lower beams.

Figure 2:
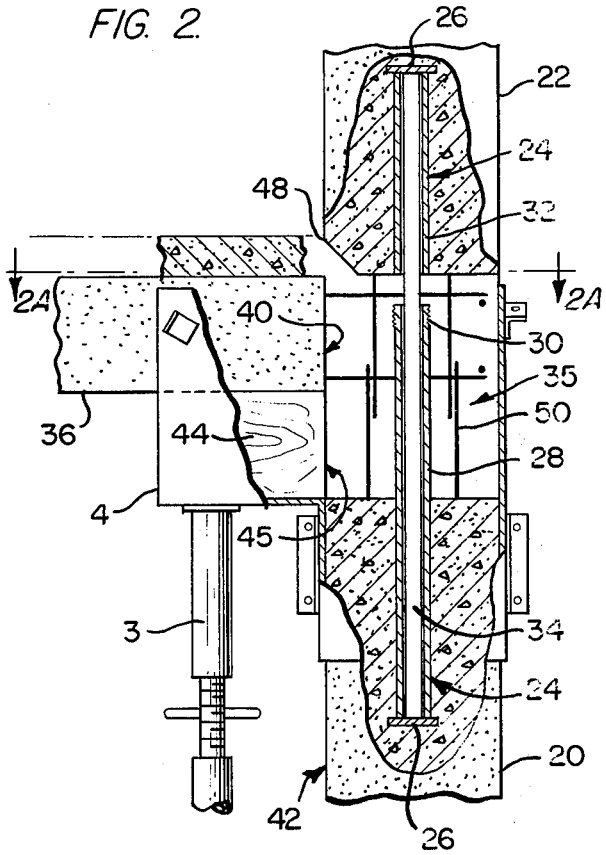
FIG. 2 is a detailed side elevation, partly in section, showing an outside corner joint in the course of being constructed using beams smaller in cross section than the posts.
Figure 2A:
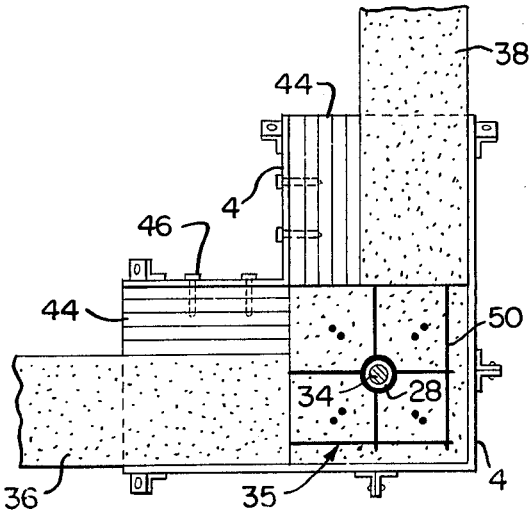
FIG. 2A is a detailed plan view of the outside corner of the building shown in FIG. 2.
Figure 3:
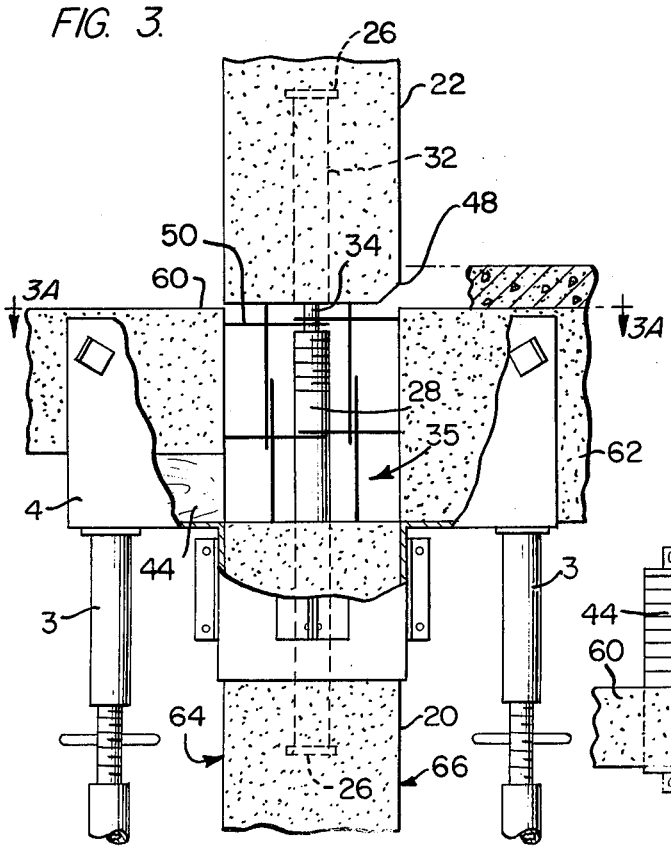
FIG. 3 is a detailed side elevation, partly in section, showing a T-joint in the course of being constructed using different size beams, all of which are smaller in cross section than the posts.
Figure 4:
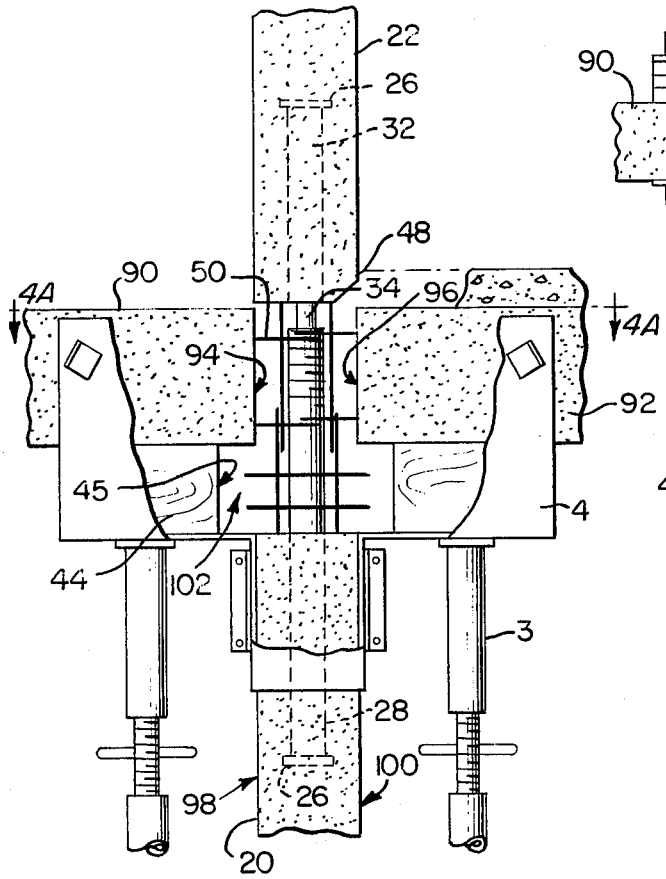
FIG. 4 is a detailed side elevation, partly in section, showing a modified T-joint in accordance with the applicant's invention in the course of being constructed using beams which are smaller in cross section than the posts and showing a concrete projection below the beams.

Referring now to FIGS. 2–4 there are shown a variety of joints that may be provided in the structural frame. More particularly, referring to FIGS. 2 and 2A there is shown a detailed side elevation and a detailed plan view of an outside corner of the structural frame shown during the process of construction using beams which are narrower than the posts.

The outside corner includes an upright lower post 20 having a square cross section measuring, for example, 20 inches by 20 inches, and a similar upright upper post 22 having the same cross section and having its vertical sides aligned with the vertical sides of lower post 20. Each post has an axial bore 24 extending a short distance into its upper and lower end. Caps 26 are molded in posts 20 and 22 at the end of bores 24.

A sleeve 28 is molded in bore 24 in the upper end of post 20 and bears on cap 26 disposed therein and projects a predetermined distance above the surface of lower post 20. The upper end of sleeve 28 has external screw threads 30 for attachment to a coupling 6 (see FIG. 1) to facilitate the handling of the post. Such a coupling is used to hoist the post into position as shown in FIG. 1.

A similar sleeve 32 is molded in bore 24 in the lower end of post 22 and bears on a similar cap 26 disposed therein. The lower end of sleeve 32 is flush with the lower end of post 22 and is located in vertical alignment with the sleeve 28 in lower post 20. The aligned end of sleeves 28 and 32 are open to receive a support rod 34 which is cut to the proper length so that it abuts against caps 26 disposed in lower post 20 and upper post 22 so as to support the bottom surface of post 22 a predetermined distance, for example, 24 inches above the top surface of lower post 20, and above the top of sleeve 32. As will be explained, this distance will be approximately the height of the largest beam that is to be united at the joint in question. If desired, shims may be dropped down to the lower end of sleeve 28 so as to support rod 34 thereon and to achieve the proper vertical spacing between the ends of posts 20 and 22.

Rod 34 is preferably made of metal and should be of sufficient size and strength so that, when it is placed between preformed building posts 20 and 22, it will support the weight of upper post 22 in the desired spaced relationship to lower post 20 until the connecting concrete can be poured and allowed to harden. Support rod 34 then becomes a permanent part of the building and provides extra strength at the joint.

It can be seen that rod 34 provides a cavity 35 between posts 20 and 22 defined by the projections of the vertically aligned walls of posts 20 and 22. A portion of form 4 is removable affixed about the top of post 20 to partially enclose cavity 35 between posts 20 and 22.

The outside corner shown in FIGS. 2 and 2A also includes horizontal beams 36 and 38 having cross sections smaller than that of post 20, for example 12 by 12 inches. The end portions of beams 36 and 38 rest in a portion of form 4 supported vertically by jacks 3. The end surface 40 of beam 36 is positioned adjacent and above the upper end of post 20 outside cavity 35 flush with wall 42 of post 20. The end portion of beam 36 does not rest upon and is not supported by the top of post 20. Because the height of beam 36 is less than the vertical distance between posts 20 and 22, filler block 44, having a height equal to the difference between the height of the beam 36 and the vertical space between posts 20 and 22, is used to help complete the enclosure around cavity 35. In FIG. 2 filler block 44 is disposed between the bottom horizontal surface of beam 36 and the confronting wall of form 4 so as to align the top horizontal surface of beam 36 with the bottom of post 22. Also in FIG. 2 it is shown that the end surface 45 of filler block 44 is aligned with inner surface 40 of beam 36 and it also rests only on the portion of the form 4 supported by jack 3 and does not rest upon and is not supported by the upper part of post 20. Filler blocks 44 are held in position by means of nails 46 projecting through holes in form 4.

Figure 5:
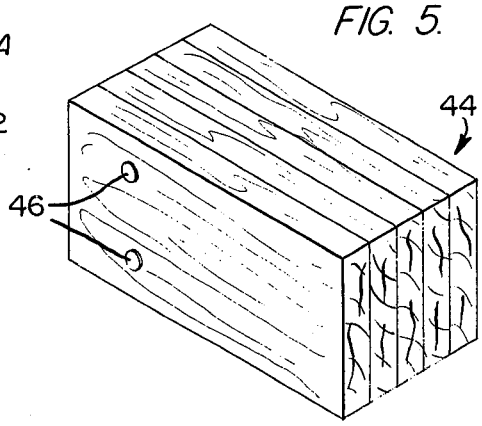
FIG. 5 is a perspective view of the filler block used in conjunction with the invention; and, FIG. 6 is a perspective view of a partially completed structural frame showing a variety of orientations beams and posts that can be achieved in the structural frame.

As shown in FIG. 5, the filler block is comprised of a number of wooden planks each having a thickness of approximately 2 inches and fastened together by nails 46 to form a block. The width and length of the planks may be adjusted as required in order to support the block in its proper position.

In FIG. 2A, it is shown that horizontal beam 36 has a width less than the width of wall 42 of post 20. Consequently, a similar filler block 44 is required between the inside vertical wall of beam 36 and the confronting wall of form 4 in order to hold beam 36 in proper horizontal alignment and to complete the enclosure around cavity 35 so that concrete poured into cavity 35 to form the joint bonding the posts and beams together will not leak out of cavity 35.

Horizontal beam 38 as shown in FIG. 2A has the same cross section as beam 36 and similarly rests in a portion of form 4 and is similarly supported by means of a filler block 44 and a jack 3 adjacent and above the upper end of post 20 but outside cavity 35.

The remaining portions of form 4 are now affixed around beams 36, 38 and post 22 in the manner described in copending application Ser. No. 564,362.

It can be seen that the confronting surfaces of the ends of beams 36 and 38, the ends of posts 20 and 22, form 4 and ends 45 of filler blocks 44 completely surround and enclose cavity 35. In FIG. 2 it is shown that the lower inside corner 48 of upper post 22 is chamferred in order to permit access to the inside of cavity 35. Also shown, in FIGS. 2 and 2A are a series of steel reinforcing rods, generally designated as 50, projecting respectively from the ends of beams 36, 38, posts 20, 22, and interconnected in a conventional manner to provide steel reinforcement for the concrete poured at the job site into cavity 35 through chamferred aperture 48.

Cavity 35 now may be filled with concrete at the job site and allowed to cure to form a unitary joint 37 (see FIG. 6) connecting the beams 36, 38 and posts 20, 22. After joint 37 has cured to a sufficient strength, jacks 3, forms 4 and filler blocks 44 may be removed to leave a unitary joint 37 connecting beams 36 and 38 to an upright column formed by joining posts 20, 22 and joint 37. Because the ends of beams 36, 38 are maintained flush with the vertical walls of posts 20, 22 and do not project into cavity 35, the upright column has a uniform cross section throughout its height to give increased strength to the column against wind stresses and earth tremors.

Figure 3A:
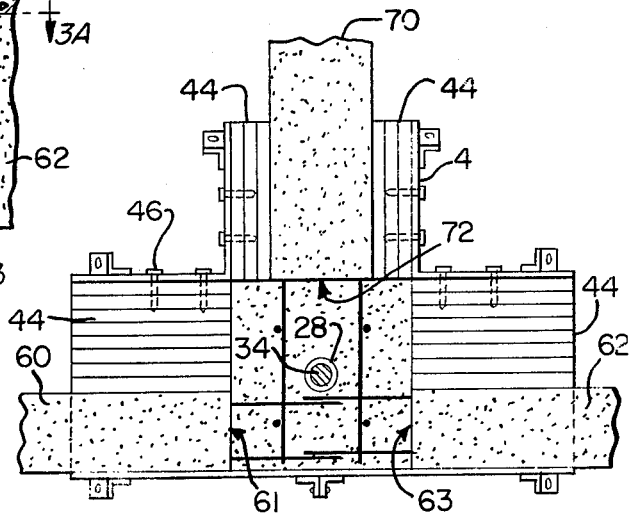
FIG. 3A is a detailed plan view of the T-joint shown in FIG. 3.

Referring now to FIGS. 3 and 3A there is shown a T-joint for the structural frame of the invention which is used at a point between corners of the building at an outside wall of the building. The T-joint joins a lower post 20 and an upper post 22 similar to those used for the embodiment shown in FIGS. 2 and 2A. Post 22 is supported vertically above, for example 24 inches above, and spaced apart from the top surface of post 20 by means of a rod 34 disposed in sleeves 28, 32 and bottomed on caps 26 in the same fashion as described in conjunction with the embodiment of FIGS. 2 and 2A. Horizontal beams 60 and 62 of different cross sections, for example 8 by 16 inches for beam 60 and 12 by 24 inches for beam 62, are aligned parallel to one another, with their end portions similarly resting in a portion of form 4 and are supported vertically by means of jacks 3 adjacent and above the upper surface of post 20 outside cavity 35. The end surface of horizontal beams 60 and 62 are flush with the adjacent vertical walls 64 and 66 of post 20. Beams 60 and 62 do not rest upon and are not supported by the top of post 20. Since the height of beam 62 is equal to the vertical distance between posts 20 and 22, there is no need to use filler block 44 under beam 62. However, it can be seen in FIG. 3A that the width of beam 62 is less than the width of vertical wall 66 of column 20 and that, therefore, a filler block 44 is needed between the inside vertical surface of beam 62 and the confronting wall of form 4. The dimensions of beam 60 require that filler blocks be used both underneath and adjacent the inside surface of beam 60 as shown in FIG. 3A. The end surfaces 45 of filler blocks 44 are aligned flush with the end surface of beam 60 so as not to project into cavity 35.

Also shown in FIG. 3A is horizontal beam 70 aligned perpendicular to beams 60 and 62 and having its end portion similarly resting in a portion of form 4 and supported by jacks 3 adjacent and above the upper end of post 20. The end surface 72 of beam 70 is flush with the inside vertical wall of post 20 and does not project into cavity 35. Beam 70, like beams 60 and 62, does not rest upon and is not supported by the top surface of post 20. Because the width of beam 70 is less than the width of the inside vertical wall of post 20, filler blocks 44 are also needed between the sides of beams 70 and the confronting walls of form 4. In order to align the center line of beam 70 so that it intersects the center line of beam 20, filler blocks 44 of desired dimensions are used on both sides of beam 20. The confronting end surfaces, 61, 63 and 72 of beams 60, 62 and 70, respectively, the ends of posts 20 and 22, form 4 and ends 45 of filler blocks 44 surround and completely enclose cavity 35 in the same manner as the embodiment shown in FIGS. 2 and 2A. This embodiment also uses a chamferred corner 48 on the bottom edge of post 22 to permit access to cavity 35 through which concrete may be poured to form unitary joint 37 uniting the beams and posts. Reinforcing rods 50 also project into cavity 35. Jacks 3, forms 4 and filler blocks 44 may be removed after joint 37 has cured to a sufficient strength to leave a unitary joint 37 uniting beams of different dimensions to an upright column comprised of posts 20, 22 and joint 37. This structure permits the architect to save construction costs by using precast posts and beams and, at the same time, have the design flexibility of joining precast beams and posts of different dimensions.

Figure 4A:
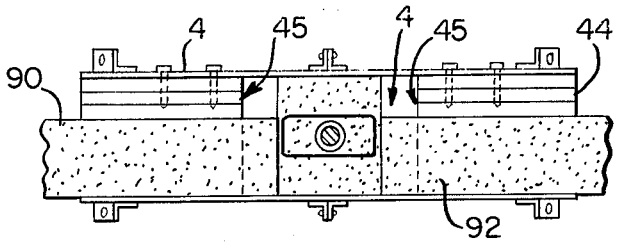
FIG. 4A is a detailed plan view of the modified joint shown in FIG. 4.

There is shown in FIGS. 4 and 4A a running unitary joint wherein two parallel horizontal beams 90 and 92 are joined to lower post 20 and upper post 22 by a special unitary joint which provides reinforcement under the ends of beams 90 and 92 that are required to carry extra heavy loads. In the embodiment of FIG. 4 the upper post 22 is supported a predetermined distance above the top surface of lower post 20 by means of a rod 34 disposed in sleeves 28 and 32 and bottoming on caps 26 as with the embodiment of FIGS. 2 and 2A. The ends of beams 90 and 92 rest in a portion of form 4 and are supported vertically by means of jacks 3, adjacent and above the upper end of post 20 and outside cavity 102 so that the inner walls 94 and 96 of beams 90 and 92 are flush with the vertical side walls 98 and 100 of lower post 20. The ends of beams 90 and 92 do not rest upon and are not supported by the top of post 20. Since the height of the beams 90 and 92 is less than the vertical space between posts 20 and 22, filler blocks 44 are required. In this embodiment filler blocks 44 are placed between the lower surface of beams 90 and 92 and the confronting wall of form 4. The inside faces 45 of filler blocks 44 are set back a predetermined distance from the end surfaces 94 and 96 of beams 90 and 92. Setting back filler blocks 44 in this fashion provides an inverted T-shaped cavity 102 extending a predetermined distance under the ends of beams 90 and 92. When concrete is poured into cavity 102 defined by the confronting surfaces of the ends 94 and 96 of beams 90, 92, respectively, the ends of posts 20,22, the ends 45 of blocks 44 and form 4, an inverted T-shaped joint 104 will be formed having projections 106 and 108 (see FIG. 6) under the ends of beams 90 and 92 to provide reinforcement which will allow the beams to carry extra heavy loads.

As with the embodiment of FIGS. 2 and 2A, steel reinforcing rods 50 project from the confronting end surfaces of the beams and posts and are tied together in a conventional way in order to provide reinforcement for the unitary joint. Lower corner 48 of post 22 is chamferred to permit access to cavity 102. Jacks 3, form 4 and filler blocks 44 may similarly be removed after the joint has cured.

Figure 6:
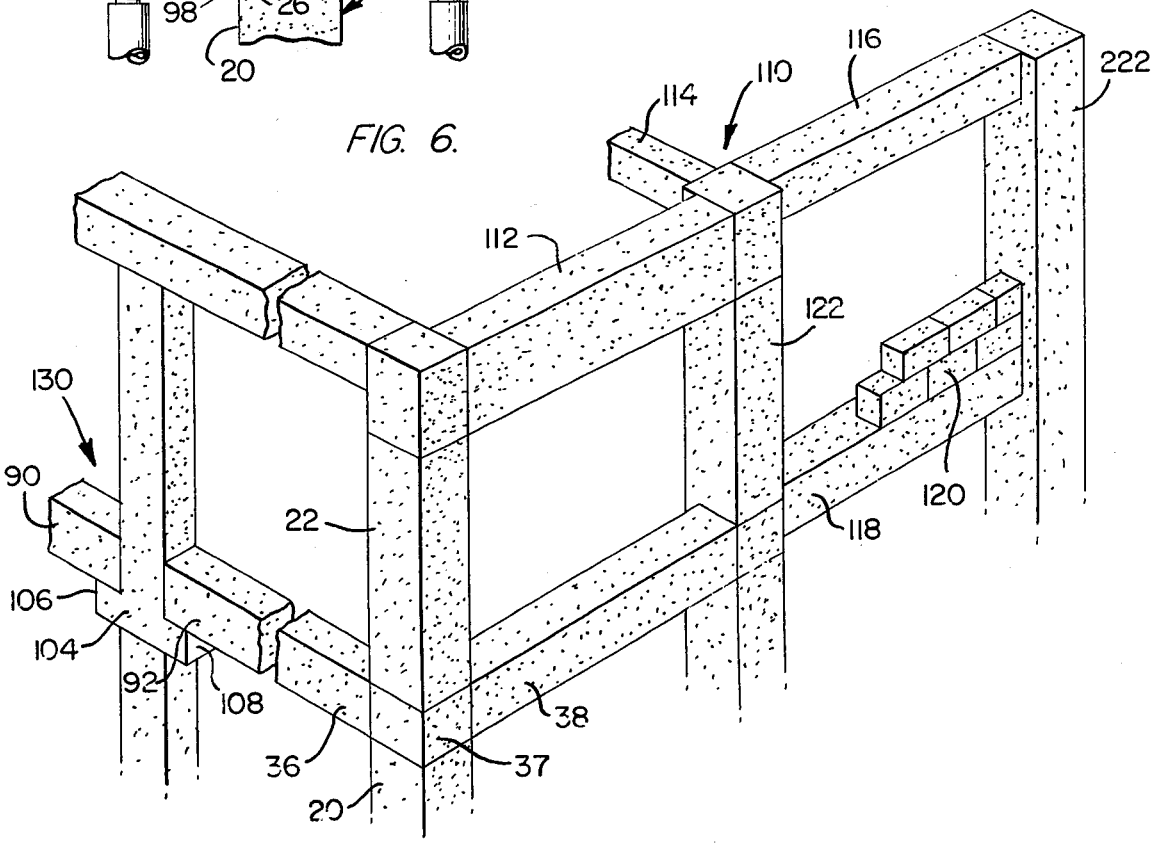

Referring now to FIG. 6, there is shown the variety of joints and outside facings that can be provided in this structural frame. The corner joint 37 of FIGS. 2 and 2A is shown in FIG. 6. The horizontal beams 36 and 38 are shown with their outside vertical surfaces aligned flush with the outside vertical surfaces of corner post 20. When forms 4 are removed, the alignment provides a smooth outer appearance for the building structure.

This configuration is generally used when the outside of the building is to be finished with an unbroken plane of brick veneer or other suitable covering so that the framework is completely covered from outside view.

The type of unitary joint shown in FIGS. 3 and 3A is shown generally in the area of FIG. 6 designated by reference numeral 110 where beams 112, 114 and 116 all of different dimensions are joined together. This adds flexibility of structural design to the economy of constructing a building of preformed posts and beams. It will be noticed that the outside vertical surfaces of beams 116 and 118 are recessed from the outside vertical walls of their adjacent posts 122 and 222. This is accomplished by moving filler blocks 44 as shown for example in FIG. 3A to the other side of beam 62. In this way beam 62 of FIG. 3A would be recessed like beam 116 of FIG. 6. This design is generally used when it is desired to leave the framework exposed. The space framed by adjacent posts 122 and 222 and beams 116 and 118 may then be closed with concrete blocks 120 set with the inside face of blocks 120 in line with the inside face of the posts 122, 222 and beams 116, 118 to provide a smooth interior wall with no exposed interior columns or beams. The exterior surface of the recessed framed spaces may then be finished with any desired material, for example, marble, aluminum or brick.

The type of running joint shown in FIGS. 4 and 4A is also shown in FIG. 6 in the area designated by reference number 130. An inverted T-joint 104 includes projections 106 and 108 which provide extra support for beams 90 and 92.

This type of structural frame can also be used in the erection of other types of concrete structures than buildings as, for example, bridges, ramps and the like. It enables the cost and duration of construction to be lowered appreciably. About 95% of the structure is formed off the jobsite, where appropriate curing can be had by means of reusable forms.

This type of structural frame allows for the convenient uniting of various size beams over a common post and provides the architect the flexibility of specifying different size beams for different areas of the building. No other structural frame constructed of preformed posts and beams provides this flexibility and economy of design.

While the invention has been illustrated and described in certain embodiments, it is recognized that variations and changes may be made therein without departing from the invention set forth in the claims.

What is claimed is:

1. A structural frame constructed with preformed posts and beams connected by unitary joints formed at the construction site, said frame comprising:

upright posts disposed in superposed relation with adjacent ends thereof substantially in vertical alignment and having axial bores extending a predetermined distance into the upper and lower ends thereof;

sleeves in said bores;

a rod disposed in said sleeves and bottomed in said bores of said adjacent superposed posts and having a length sufficient to support said upper post a predetermined distance above said lower post and providing a cavity therebetween defined by the projections of the aligned walls thereof;

means removably attached to said posts for enclosing said cavity and having an aperture therein for permitting access thereto;

a uniting piece formed at the building site in said enclosing means and allowed to cure in order to form a unitary joint uniting said posts together to provide an upright column with said posts;

one or more horizontal beams having generally rectangular cross sections and having one end positioned adjacent and above the upper end of said lower post outside of said cavity and having its end surface aligned flush with the adjacent vertical side wall of said lower post; and, wherein said uniting piece forms a unitary joint uniting said posts and beams together;

the cross-sectional area of at least one of said beams being less than the surface area of the cavity adjacent to the end surface of said beam; and, wherein said enclosing means includes removable filler blocks having sufficient dimensions to fill the voids left in the enclosing means by the smaller beam and having their end surfaces aligned flush with the end surfaces of said beam outside said cavity.

2. The structural frame of claim 1 wherein at least one of said beams has a width narrower than the width of said posts, said beam having its outside vertical side wall aligned in the plane of the corresponding outside vertical side wall of said posts; and, wherein said enclosing means includes a removable filler block supported adjacent the inside vertical sidewall of said beam and having a width equal to the difference between the beam width and the post width and having its end surface aligned flush with the end surface of said beam outside said cavity so as to fill the void left in the enclosing means by the narrow beam.

3. The structural frame of claim 2 wherein the inner vertical sidewall of the beam is aligned with the corresponding inner surface of the post.

4. The structural frame of claim 1 wherein the height of at least one of said beams is less than the vertical space between said upper and lower posts; and, wherein said enclosing means includes a removable filler block supported under the beam and having a height equal to the difference between the height of the beam and the vertical space between the upper and lower posts and having its end surface aligned flush with the end surfaces of said beam outside said cavity, so as to fill the void left in the enclosing means by the thin beam.

5. The structural frame according to claim 1 wherein the height of at least one of said beams is less than the vertical space between said upper and lower posts; and, wherein said enclosing means includes removeable filler blocks supported under the beam and having a height equal to the difference in height between the height of the beam and the vertical space between the upper and lower posts said filler block having its end surface recessed from the end of the beam so as to provide a joint with reinforcing projections under said beam.

6. A structural frame constructed with preformed concrete posts and beams united by unitary concrete joints formed at the construction site, said frame comprising:

a first upright post supported upon a footing having;

a generally rectangular cross section; and, a first axial bore extending a predetermined distance into its upper end;

a first cap molded in said first post at the end of said first bore;

a first sleeve molded in said first bore and bottomed on said first cap;

a rod disposed in said first sleeve and bottomed on said first cap extending a predetermined distance out of said first bore;

a second upright post superposed above and aligned with said first post and having;

the same generally rectangular cross section as said first post;

second and third axial bores extending predetermined distances into its upper and lower ends respectively; and, second and third caps molded in said second post at the end of said second and third bores;

second and third sleeves molded in second and third bores and bottomed on said second and third caps, respectively;

said rod also disposed in said third sleeve and bottomed on said third cap and supporting said second post a predetermined distance above the top surface of said first post and providing a cavity therebetween defined by the projections of the aligned walls thereof;

one or more horizontal beams having generally rectangular cross sections and having one end positioned adjacent and above the upper end of said first post outside said cavity and having at least one vertical sidewall thereof aligned with a vertical sidewall of said first post so that said post provides no direct support for said beams;

means removably attached to said posts and beams for enclosing said cavity, said means having an aperture therein for permitting access thereto; and, a uniting piece of concrete poured at the building site into said cavity and allowed to cure in order to form a unitary joint thereof uniting said posts and beams.

* * * * *